United States Patent [19]

Maguire

[11] 3,966,188

[45] June 29, 1976

[54] LABEL TRANSPORT

[75] Inventor: D. Bruce Maguire, Ballwin, Mo.

[73] Assignee: Emerson Electric Co., St. Louis, Mo.

[22] Filed: Jan. 2, 1975

[21] Appl. No.: 537,934

[52] U.S. Cl. ..... 271/9; 198/32; 198/167; 271/184; 271/225; 271/251; 271/274

[51] Int. Cl.[2] ..... B65H 9/16; B65H 5/26

[58] Field of Search ..... 198/32, 167; 271/9, 271/225, 184, 251, 274, 275, 259, 262, 263

[56] References Cited

UNITED STATES PATENTS

| | | | |
|---|---|---|---|
| 2,094,879 | 10/1937 | Erb | 271/225 |
| 2,464,173 | 3/1949 | Broadmeyer | 271/251 |
| 2,665,633 | 1/1954 | Schubert | 271/225 |
| 3,176,980 | 4/1965 | Mitchell et al. | 271/251 |
| 3,355,006 | 11/1967 | Heilbrunn | 198/167 |
| 3,603,680 | 9/1971 | Barton | 271/259 |
| 3,741,536 | 6/1973 | Anderson | 271/274 |
| 3,778,629 | 12/1973 | Terryn | 271/259 |
| 3,831,733 | 8/1974 | Howard et al. | 198/32 |
| 3,880,420 | 4/1975 | Martin | 271/184 |

*Primary Examiner*—John J. Love
*Assistant Examiner*—Jeffrey V. Nase
*Attorney, Agent, or Firm*—Polster and Polster

[57] ABSTRACT

A transport for conveying an article between two positions is provided which is capable of high speed article transfer while maintaining positive article control. The preferred embodiment is intended to operate with relatively thin and small labels finding applications as postal destination designators. The transport includes a plurality of aligned take-away devices which receive a set of articles from the output side of a high speed cutter. Each of the take-away devices includes at least one conveyor for advancing an individual article. The individual take-away devices also exerts positive control on each article during article advancement along the conveyor. The conveyor of each take-away devices is timed so that articles advancing along successive conveyors are automatically staggered with respect to other articles in each set. The speed of the conveyors of each take-away devices is set so that the transport acts as a constant speed device, regardless of the input speed of articles into the transport. A main conveyor receives the articles from the take-away devices and advances them in a direction generally normal to the direction of advancement of the take-away devices. Positive control is maintained on the articles as they travel along the main conveyor. The articles are deposited at a stacking and bundling station adjacent the main conveyor termination point.

9 Claims, 6 Drawing Figures

LABEL TRANSPORT

BACKGROUND OF THE INVENTION

This invention relates to transport devices and in particular to a high speed transport for handling relatively small and flexible articles. While the invention is described with particular emphasis on its use in conjunction with mail tag destinators, those skilled in the art will recognize the wide applicability of the invention to other uses and systems.

There recently has been an increase in the use by postal authorities of automation techniques for providing systematic handling of mail bags. Commonly, outgoing mail is placed in a conventional canvas mailbag and the bag is sealed. A clip having space for inserting a mail tag is attached to each bag and a mail tag is inserted in the clip. The mail tag commonly lists the destination, zip code of that destination, and the point of origin for the mailbag contents. In larger mail processing centers, each individual mailbag is taken by a worker who either manually or mechanically reads the zip code from the mailbag, manually inserts or automatically encodes the zip code into computer language at a data input terminal, and places the mailbag on a conveyor. The zip code information is transmitted by the automatic or manual data terminal to a control station, for example, a computer which controls the conveyor. The control station can be programmed so that it will remove the mailbag from the conveyor at a proper destination output position when conveyor-bay travel reaches that proper position.

The use of automated processing equipment greatly reduces the handling time required to process large volumes of mail. However, the widespread use of automated equipment has generated a number of peripheral problems heretofore unresolved in the art. One of these peripheral problems involves the manufacture of reliably readable mail tags. Postal application mail tags are intended to be disposable and low in cost. By their very nature, they are a high volume product which should lend themselves to high speed manufacturing techniques. Automated manufacturing techniques have been hampered, however, because devices capable of high speed handling of mail tags after their printing and cutting have not been available commercially. While some commercially available equipment can be adapted to mail tag manufacturing, in general, available equipment has been unreliable when high speed operation of the equipment is attempted. Consequently, optimum production of the tags has not been realized. The unreliability of prior art equipment in large measure is caused by the relatively small size and flexibility of the mail tags. That is, because the tags are relatively thin and flexible, they tend to jam easily and prior art machines encounter recurring jamming when high speed operation is attempted.

The invention disclosed hereinafter provides a high speed transport capable of reliably working in conjunction with high output apparatus. The device finds particular application as an interface between a slitter cutter for manufacturing mail tags and a stacking and bundling machine in that it receives labels from the slitter cutter, and advances them to a stacking and bundling station at a speed comparable with either the printing or cutting operation.

One of the objects of this invention is to provide a high speed article transport device.

Another object of this invention is to provide an article transport device which maintains positive control of each article under transport.

Yet another object of this invention is to provide a low cost transport device capable of operating for long, uninterrupted production run time periods.

Still another object of this invention is to provide means for transporting and spacing individual articles of a predetermined group which operates at the highest rate of any apparatus associated with the article manufacture.

Other objects will be apparent to those skilled in the art in light of the following description and accompanying drawings.

SUMMARY OF THE INVENTION

In accordance with this invention, generally stated, a transport for conveying an article is provided having a plurality of longitudinally aligned take away means which receive groups of articles from a high output manufacturing machine. Each of the take away means is designed to maintain two point, positive control of an individual article. The take away means includes a first conveyor which transports the article from the output side of the manufacturing machine to a second conveyor. Each of the aligned take away means are timed differently with respect to one another so that sets of articles arrive at the second conveyor in spaced relation to one another. The speed of the slowest take away means is set with respect to the speed of the fastest take away means so that at the highest output rate of the manufacturing machine, the spacing between the ends of groups of articles is equal to or greater than the spacing between individual articles within each group. As the rate of the manufacturing machine decreases, the spacing between articles in each group remains constant but the spacing between groups of articles increases. Guide means and a plurality of skewed idler wheels are utilized in conjunction with the second conveyor to maintain positive control of the individual articles during article transfer along the second conveyor.

DESCRIPTION OF THE PREFERRED EMBODIMENT

Figures 1, 2:
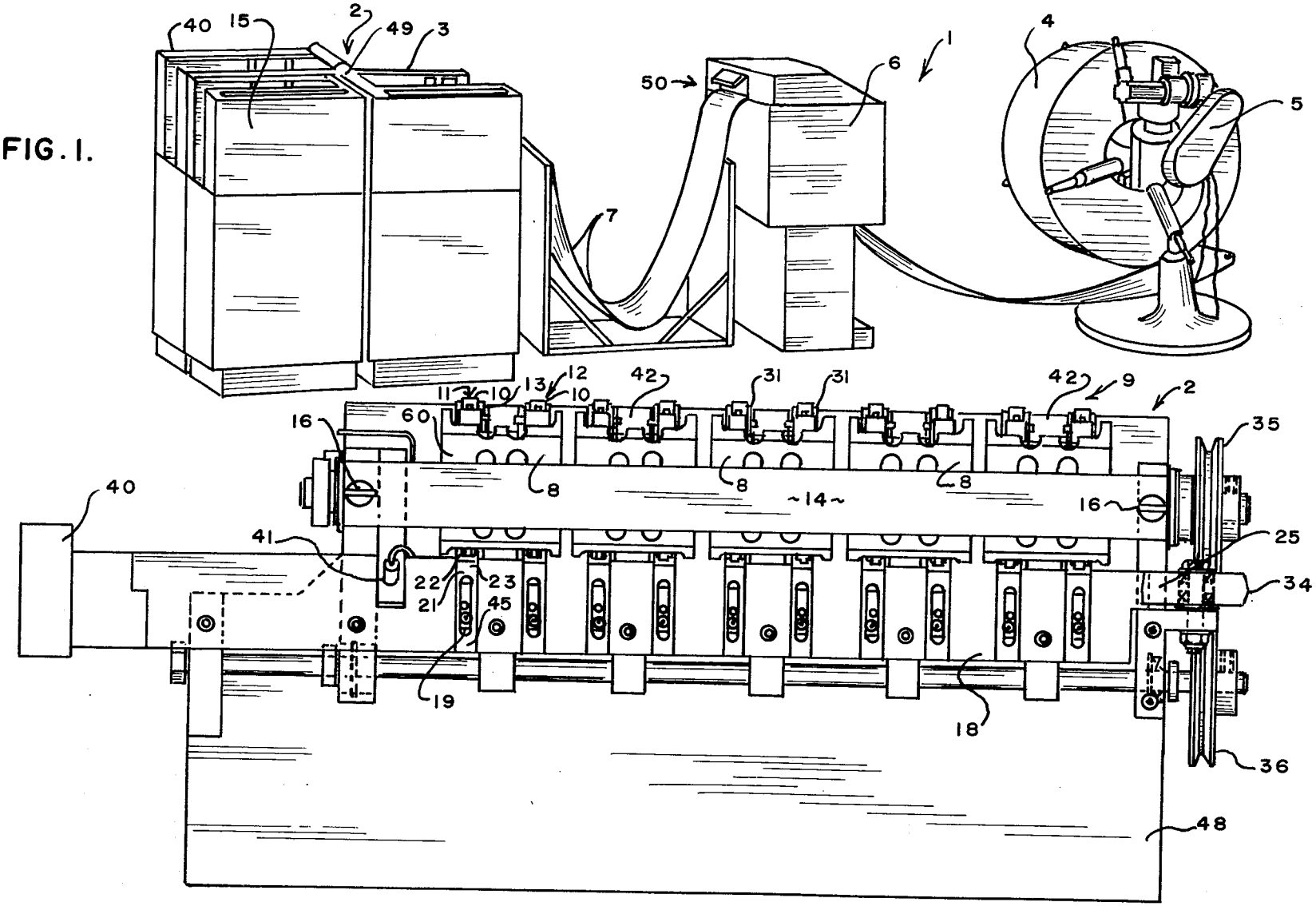
FIG. 1 is a view in perspective of a manufacturing system utilizing the transport of this invention.
FIG. 2 is a top plan view of the transport utilized in conjunction with the manufacturing system of FIG. 1.

Referring now to FIG. 1, reference numeral 1 indicates a manufacturing system utilizing a transport 2 of this invention. The particular embodiment of the transport 2 described hereinafter is designed to transport mail tag labels and to permit their later handling after manufacture at a stacking and bundling station. In order to fully appreciate the invention disclosed hereinafter, the size, thickness, and speed with which mail tag labels are manufactured should be kept in mind. Mail tag labels with which the invention finds application conventionally have a length dimension of 3.3 inches, a width dimension of 0.969 inches, and a thickness of 0.008 inch. Such labels are delivered from an automatic slitter-cutter machine 3 at various rates up to 80,000 labels per hour, in a five-up configuration. That is to say, the output of the slitter-cutter 3 is a row or group of five aligned labels. Prior to the development of the subject invention, the lack of a suitable means to gather, transport, and stack a row of multiple labels forming the output of a high speed slitter-cutter precluded the application of existing slitter-cutter technology to the production of mail tag labels.

In general, the labels are manufactured from a paper roll stock 4 mounted on a conventional dereeling device 5. The paper supply commonly is available in rolls of a capacity of 16,000 feet, at 0.008 inch thickness. The dereeler 5 is available commercially and is not described in detail. The roll stock 4 is fed into a high speed printer 6 which applies the desired data in sets to the roll stock 4. For example, in United States postal services application, each label is imprinted with unique data relative to origin, destination, transportation route, type of mail, date and special codes. Preferably, the printer 6 is directed by a computer, not shown, which stores the data on each label to be printed. The dereeler 5 supplies paper from the roll stock 4 upon demand of the printer 6. A buffer loop 7 is provided on an output side 50 of the printer 6, between the printer 6 and the slitter-cutter 3. Buffer loop 7 is desirable in that it permits the printer 6 to operate at a speed somewhat different from that of the slitter-cutter 3. Consequently, no precautions need be taken to insure in-phase operation of the printer 6 and slitter-cutter 3. In addition, the loop provides drying time for various inks that may be utilized in conjunction with the printer 6.

The slitter-cutter 3 slits the paper rolled stock 4 as it advances the roll the depth of the document which, in the application described, is the width dimension of the label, 0.969 inch. The number of slits made varies with the application. In the embodiment illustrated, the roll stock 4 is slit in six places, resulting in five bands of printed paper and two outer ribbons of scrap. A guillotine type cutter then cuts the paper bands at the desired document width, which results in groups of individual labels. Each group of labels constitute a set of articles which are taken from the output side of the cutter 3, generally indicated by the numeral 49, and delivered to a stacking and bundling station 40 by the transport 2 of this invention.

Referring now to FIG. 2, transport 2 includes a plurality of take away means 8 which are aligned longitudinally in a row 9. The number of take away means 8 used in any particular embodiment of the transport 2 varies with the individual application. As indicated above, the slitter-cutter 3 produces sets of articles having five individual members comprising the set. An individual take away means 8 is provided for each member of the set.

Individual ones of the take away means 8 plurality are identical and only a single take away means 8 is described in detail. In general, the take away means 8 includes a housing 60 which has a plurality of idlers 10 operatively associated with it. Each of the idlers 10 include a roller 44, illustrated in FIG. 5, which preferably is attached to the housing 60 so as to exert a force against a conveying device 13. The attachment structure is described in detail hereinafter. The idlers 10 are spaced along the length of the housing 60 at some predetermined distance. The number of idlers 10 and the spacing between them is a determination made for each application. That is, in the label application described herein, the idlers 10 are arranged in two parallel columns 11 and 12, respectively. The columns 11 and 12 are spaced from one another longitudinally so that they engage the article to be transported, in this case, an individual label, which, as indicated above, has dimensions of approximately 3.3 by 0.969 by 0.008 inches, near the outer edges of the article. In addition, the idlers 10 of each of the columns 11 and 12 are spaced so that an individual article always is positively passed from one idler 10 to the next. For the purposes of this specification, the terms positively passed are taken to mean that the distance between each of the rollers 44 in the columns 11 and 12 is less than the width dimension of the article being transferred.

One of the conveying devices 13 is associated with each of the take away means 8. In the embodiment illustrated, the conveying device 13 comprises a pair of conveyor belts 31, respective ones of which are aligned with the columns 11 and 12 of the idlers 10. However, other embodiments of this invention may utilize a single conveyor belt for the conveying device 13, if desired. The belts 31 are conventional, flat belt type conveyors extending about a plurality of rollers 32. Operation of the conveying device 13 is more fully described hereinafter. A plate 42 defines a channel for belt 31 movement and aids in supporting each article as it is carried through the take away means 8. Plate 42, shown in FIG. 5, may be mounted to the transport 2 at any convenient location. For example, the plate 42 may be attached to an enclosure structure 15 with conventional threaded fasteners. Other constructional arrangements are compatible with the broader aspects of this invention. Thus, for example, one commercial embodiment of this invention eliminates the plate 42, and for that reason, the plate 42 is not shown in the other drawing views.

A positioning bar 14 holds the take away means 8 plurality in alignment with one another and the individual take away means 8 in alignment with its respective conveying device 13. Positioning bar 14 preferably need be no more than conventional bar stock which is secured to the enclosure structure 15 of the transport 2 at any convenient location. A typical attachment is indicated generally by the numeral 16 in FIG. 2.

Each of the idlers 10 are spring loaded against the belts 31 of the conveying devices 13 by a spring 43 operatively connected between the housing 60 and the roller 44 of the idlers 10. That spring bias insures that individual articles are positively passed between successive idlers 10 in the operation of transport 2. A guide plate 17 supports a plate assembly 18. The guide plate 17 is described in greater detail hereinafter. Plate assembly 18 has a plurality of openings 19 in it which are designed to receive a spring 20. Spring 20 is operatively biased between the plate assembly 18 and a first end 45 of an arm 21. A second end 23 of the arm 21 has an idler wheel 22 rotatably attached to it. Each of the columns 11 and 12 of the take away means 8 plurality has an idler wheel 22 associated with it in the manner described. The idler wheel 22 functions to insure jam-free passage of an article from the conveying device 13 to a second conveyor 25. In the application disclosed, the idlers 10 exert approximately a one-ounce force against the conveyor 13. Idler wheel 22, on the other hand, exerts a force of approximately two pounds against the conveyor 13. As later described, this means an article must be substantially clear of idler wheel 22 before the second conveyor 25 portion of the transport 2 is able to operate on the article.

Figure 3:
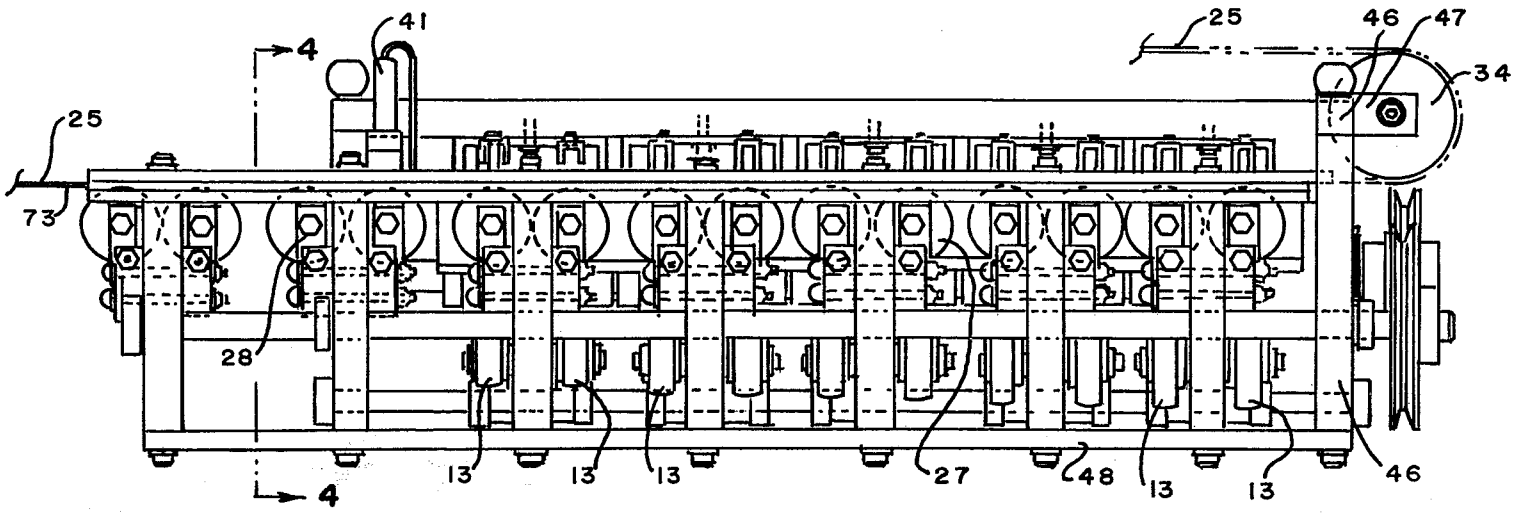
FIG. 3 is a view in side elevation of the transport of FIG. 2.
Figure 4:
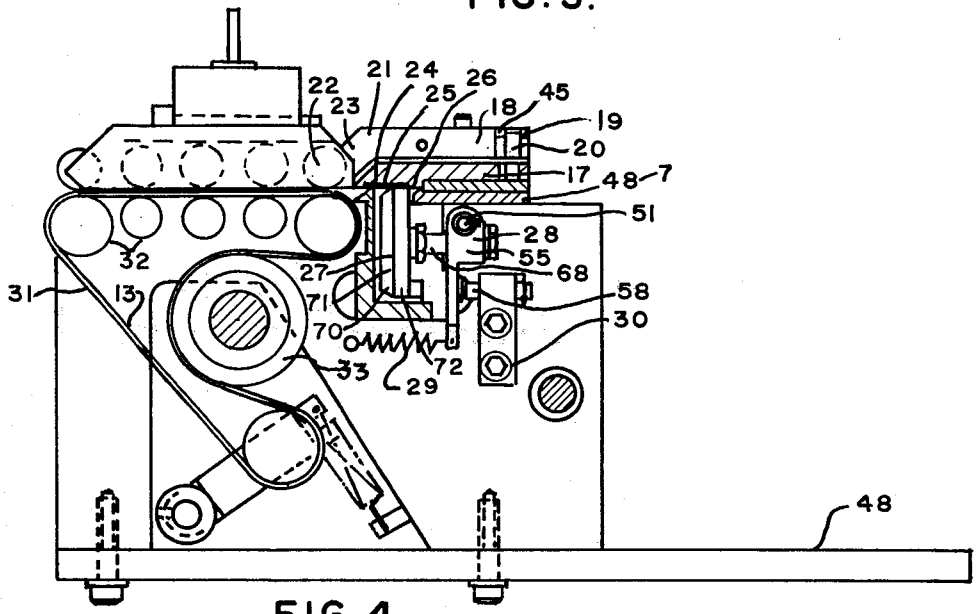
FIG. 4 is a sectional view taken along the line 4—4 of FIG. 3.

Guide plate 17, in addition to supporting plate assembly 18 on its upper side, has a groove 24 formed on its lower side, which is sized to receive the conveyor 25 in a free slip fit. This arrangement is best observed in FIG. 4. An edge 26 of the groove 24 defines an alignment guide for articles as they pass from the take away means 8 plurality to the conveyor 25. The conveyor 25 is a conventional flat belt conveyor which is wrapped about a pair of idler wheels 34, only one of which is shown in the drawings. The wheel 34 shown is rotatably mounted to a bracket 47 extending outwardly from a side plate 46. Plate 46 in turn is attached to a base structure 48 by any convenient method. Conventional threaded fasteners work well, for example. The second wheel 34 mounted on the left side of the transport 2, left being referenced to FIG. 3, may utilize a similar mounting arrangement.

A plurality of large diameter main guide idlers 27 are rotatably mounted to individual ones of a plurality of support assemblies 28. Each support assembly 28 includes an axle 68 pivotally mounted to a member 55 at a pivot indicated generally by the numeral 51. Each support assembly 28 also is biased by a spring 29 so as to permit the guide idlers 27 to exert an upward force against the conveyor 25. In the embodiment illustrated, a limiter block 30 is mounted in the vicinity of each of the support assemblies 28. The limiter 30 prevents excessive deflection of the idlers 27. The limiter block 30 may include an adjustable stop 58 to permit selective adjustment of the deflection permitted the idlers 27.

The idlers 27 include an outer axial wall 70. The wall 70 is chamfered for approximately one-half its length along a portion 71 of the wall 70. A portion 72 of its wall 70 remains substantially cylindrical. Because of the chamfer applied to the idlers 27, the wall 70 assumes the shape of a partial frustum when viewed in side elevation. The idlers 27 are positioned with respect to the take away means 8 so that individual ones of the labels are inserted between the conveyor 25 and the idlers 27. The idlers in effect hold the individual labels against a lower side 73 of the conveyor 25. The portion 71 — conveyor 25 relationship defines a pocket for label insertion and the portion 71 helps to guide the labels into a final position between the portion 72 of the idlers 27 and side 73 of the conveyor 25.

As indicated above, the conveying device 13 preferably comprises a plurality of conveyor belts 31 which are wound around a plurality of rollers 32. Each of belts also is wound around a timing roller 33. The timing roller 33 of each of the conveyors 31 of the aligned take away means 8 have different diameters. That is, the diameters of the timing roller 33 of an individual take away means 8 is chosen so as to vary the speed of the conveyor belt 31 pairs for each of the individual take away means 8. Consequently, the take away means 8 shown on the left of FIG. 2 has a roller 33 diameter such that the conveying device 13 will have the highest speed for that take away means 8. Successive ones of the take away means 8 are operated at progressively slower speeds so that the conveying device 13 of the rightmost take away means 8 operates at the lowest speed. The staggered speeds of the take away means 8 plurality enables articles to be transferred to the conveyor 25 in spaced relationship with one another, even though they enter the respective take away means 8 essentially adjacent one another.

A pair of sheaves 35 and 36, respectively, are operatively connected as for example, by a belt drive, to a source of power for driving each of the sheaves. The sheaves 35 and 36 in turn couple the source of power to the conveying device 13 and the conveyor 25. The sheaves 35 and 36 are rotatably mounted to the transport 2 by any convenient method, examples of which are known in the art.

Figure 5:
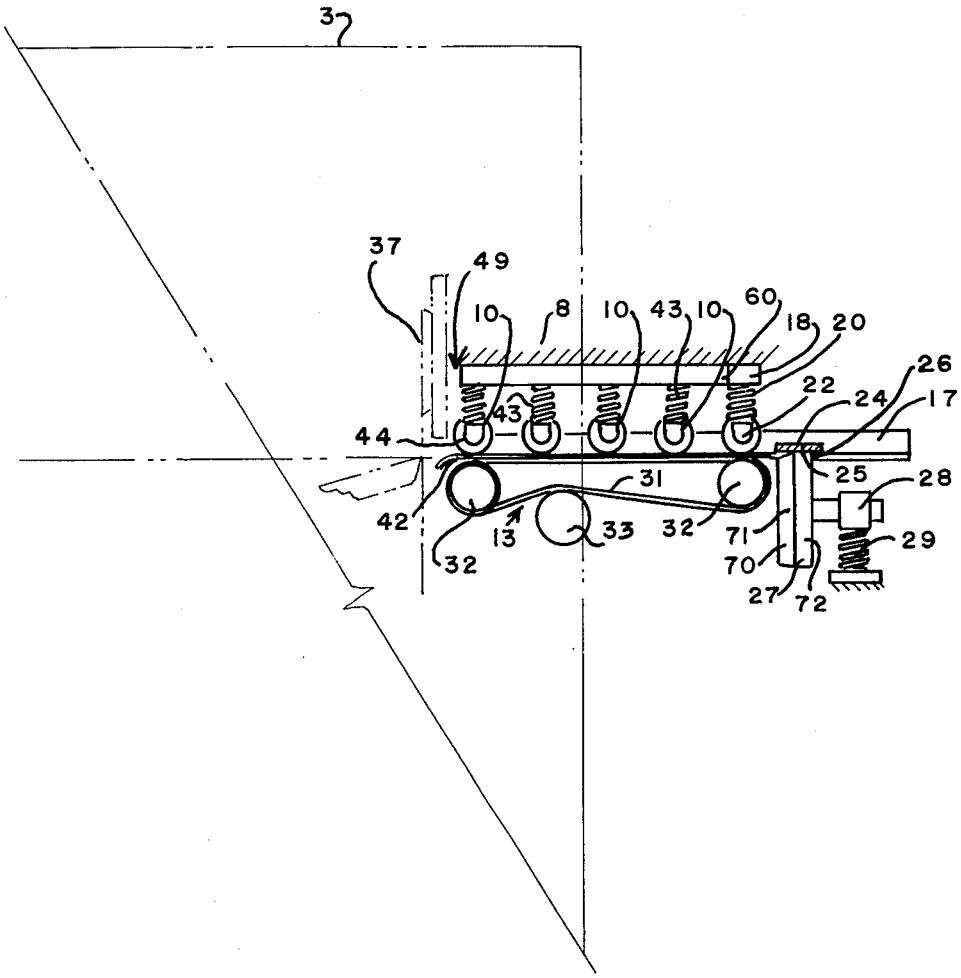
FIG. 5 is a diagrammatic representation useful for explanation purposes, illustrating the operation of the transport of this invention.

Operation of the transport of this invention is best understood when described in relation to FIGS. 2 and 5. As there shown, a blade 37 of cutter 3 severs individual articles or labels which immediately are taken up by respective ones of the conveying devices 13. As indicated, the idlers 10 maintain positive contact with each of the articles as they progress through the respective take away means 8. The conveyor 25 extends normally to the direction of travel of the conveying device 13 plurality. Consequently, at least three problems are encountered and overcome by my invention in transferring the relatively thin and flexible paper label from the output side 49 of the slitter-cutter 3 to the stacking and bundling station 40. One problem deals with label spacing on the conveyor 25. In order to permit the eventual stacking or handling of the severed labels, some time difference between successive ones of the groups of five labels generated by each stroke of the blade 37 must be provided. The apparatus of this invention accomplishes separation by use of the timing rollers 33. As discussed previously, the leftmost take away means 8, left being referenced to FIG. 2, operates at the highest speed, the speeds of the other four take away means 8 being set progressively lower. The speed of the rightmost take away means 8 is set so that the last label from a first label group which passes to the conveyor 25 from the rightmost take away means 8 clears the leftmost take away means 8 before the first label of a second label group passes to the conveyor 25 from the leftmost take away means 8. Restated, the speeds of all five take away means 8 are set so that at the highest cutting rate of the cutter 3, the spacing between the end labels of successive label groups preferably is equal to or greater than the spacing of the labels within each group. The take away means 8 plurality then may be considered as operating at constant speed independent of the rate at which the cutter 3 may be operating. That is to say, as the rate of the cutter 3 decreases, the spacing between individual labels in a particular group remains constant. However, the spacing between succeeding groups of labels is increased.

A second problem area involves the transfer of the labels from each of the conveying devices 13 to the conveyor 25. Since the direction of movement of conveyor 25 is normal to that of conveying devices 13, unless the label is completely clear of the take away means 8 before movement of the label in the direction of conveyor 25 travel occurs, jamming of the label is likely to result. The use of the relatively high pressure idler 22 is important in the resolution of this problem. The use of idler 22 requires the conveying device 13 to force or positively drive an individual label between the conveyor 25 and the guide idlers 27. In addition, it holds the label securely against transverse movement until the label actually clears the take away means 8. Consequently, jamming of the labels at the transfer point between the conveying device 13 and the conveyor 25 is substantially eliminated.

Figure 6:
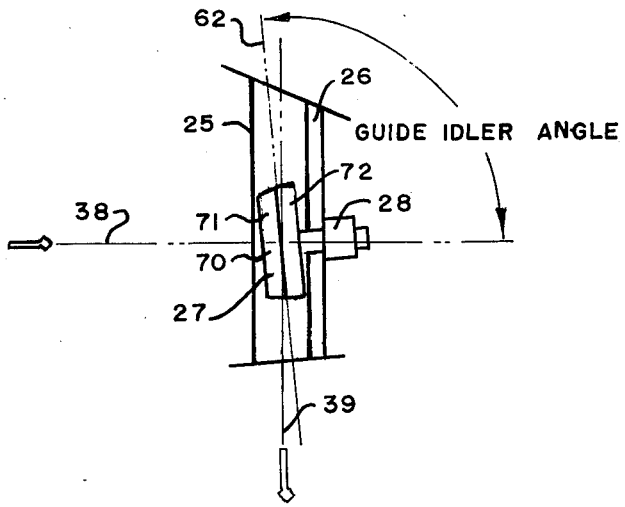
FIG. 6 is a diagrammatic view taken along the line 6—6 of FIG. 5.

Finally, the labels must be positively controlled during the transit time along the conveyor 25, or labels from the rightmost take away means 8 may catch or jam on adjacent take away means 8 as they travel leftward on the conveyor 25, direction of movement again being referenced to FIG. 2. The design of the guide idlers 27 is important in eliminating this problem. As diagrammatically illustrated in FIG. 6, each of the idlers 27 generally is a frustum shape in side elevation. In addition, the support assembly 28 is designed to permit the idlers 27 to be skewed with respect to the conveyor 25. As shown in FIG. 6, a center line 62 of the side wall 70, which defines the outer peripheral boundary of the idlers 27, lies at an angle other than 90° with respect to both an axis of article movement 38 from an individual take away means 8 and an axis of article movement 39 coincidental with the direction of conveyor 25 movement. The idlers 27 will tend to move individual articles rightwardly, as referenced to FIG. 6, during operation of the transport 2. Consequently, articles riding on conveyor 25 are directed towards the edge 26 of the guide plate 17.

These constructional features are particularly important in avoiding jams in production models of the transport 2 of this invention. Thus, as an individual label passes beneath the idler 22, it is forced between the conveyor 25 and the idlers 27. As indicated, the label must be substantially clear of the idler 22, and consequently the take away means 8, before the motion of conveyor 25 will enable it to be carried normally to its original direction of motion. Likewise, the action of the skewed idlers 27 tends to drive the article against the edge 26. This prevents articles from catching on the aligned take away means 8 as the article proceeds from the right to the left, referenced to FIG. 2, along the conveyor 25. The guide idlers 27 are spaced with respect to one another so that each label always is under the control of two of the idlers 27 as the labels move along the conveyor 25 in the vicinity of take away means 8. After the labels have passed the leftmost take away means 8, the guide idlers 27 may be spaced so that each label is always under the control of at least one idler 27.

The conveyor 25 carries the articles to a stacking and bundling station, generally indicated by the numeral 40 in FIG. 2. In actual applicational use, the station 40 may form a part of the transport 2 enclosure structure 15. Stacking and bundling station 40 may comprise any of a variety of commercially available devices for stacking and automatically packaging the labels as they arrive at the discharge point of conveyor 25. Thereafter, the labels are ejected to otherwise removed from the station 40, ready for further use. Jam detection means 41 preferably is mounted on the end run side of the conveyor 25. Detecting means may comprise a variety of commercial available devices which sense the passage of an article and which remain in a passive state until article passage is no longer sensed. Thereafter, detection means 41 conventionally generates a signal which interrupts operation of transport 2. Detection means are available commercially which may coordinate the operation of slitter-cutter 3 so that operation of transport 2 is not interrupted, even when relatively large times occur between groups of articles.

Numerous variations, within the scope of the appended claims, will be apparent to those skilled in the art in light of the foregoing description and accompanying drawings. Thus, the number of take away means 8 utilized in conjunction with the conveyor 25 may vary in other embodiments of this invention. Likewise, the methods for mounting the take away means 8 and the arm 21 may vary. While specific forces were illustratively set forth in the body of the specification, the forces actually used may vary with other applications or other embodiments of this invention. As indicated, the dual conveyor of the conveying device 13 of each of the take away means 8 may be replaced with a single belt device, if desired. Conversely, the conveyor 25 may be of a multiple belt design. Various stylized enclosures may be used in conjunction with the transport 2 and the enclosure shown in FIG. 1 merely is indicative of the wide variety available. Other drives for powering the conveying device 13 and conveyor 25 may be used. For example, both a gear driven system or a hydraulically driven system are compatible with the broader aspects of this invention. These variations are merely illustrative.

Having thus described the invention, what is claimed and desired to be secured by letters patent is:

1. A transport for conveying a plurality of articles between a first receiving position and a second position, comprising:

a plurality of longitudinally aligned take-away means having a first input side and a second output side, each of said take-away means including a conveying device for transporting individual ones of said articles in a first direction, the conveying devices of each of said take-away means plurality having substantially equal lengths, and a plurality of first idlers for maintaining positive control of individual ones of said articles as said articles move along said conveying device, individual ones of the conveying devices of said take-away means plurality being driven at progressively different speeds so as to stagger alignment of said articles, said articles being received at the input side of the take-away means plurality as groups of aligned articles, the speed of the slowest take-away means being set with respect to the speed of the fastest take-away means so that the spacing between groups of articles arriving at the output sides of said take-away mean plurality is at least equal to the spacing between individual articles within each group;

guide means positioned at the output sides of said take-away means plurality, said guide means including an edge alignment portion for receiving an edge of individual articles in abutting relationship;

main conveyor means having an upper side and a lower side, said main conveyor means extending between the output sides of said take-away means plurality and said second position;

at least one main idler at the termination of each of said take-away means plurality, said main guide idler abutting said main conveyor on the lower main conveyor side, said main guide idler exerting a force on said articles which tends to drive said articles into abuttment with said edge alignment guide, said articles being inserted between said main guide idler and said conveyor on the lower side of said main conveyor;

means for driving said main conveyor means; and means for varying the speed of said conveying devices.

2. The transport of claim 1 wherein each of said take away means is further characterized by a housing, said housing having said first idler plurality mounted to it, said first idler plurality being arranged in at least one column, said first idlers being spaced from one another in said column so that at least two of said first idlers are in contact with said article as said article moves along said take away means.

3. The transport of claim 2 wherein said first idler plurality are arranged in first and second columns, the first idlers of each of said columns being spaced from one another in said respective columns so that at least two of said first idlers of each column are in contact with said article as said article moves along said take away means, said conveying device comprising first and second conveyor belts aligned with said first idler columns.

4. The transport of claim 2 further characterized by a second idler mounted at the distal end of said column, said second idler exerting a substantially greater force against said conveying device than any of the individual ones of said first idler plurality.

5. The transport of claim 4 wherein said main conveyor means is positioned so that the direction of travel of articles of said main conveyor means is normal to the direction of travel of the individual conveying devices of said take away means plurality.

6. The transport of claim 5 wherein said main guide idler is skewed with respect to an axis defined by the direction of travel of said conveying devices.

7. The transport of claim 5 wherein said main guide idler is skewed with respect to an axis defined by the direction of travel of said main conveyor means.

8. The transport of claim 7 further characterized by a plurality of said main guide idlers, each of said main guide idlers being skewed with respect to the direction of travel of said main conveyor means, said main guide idlers being spaced from one another so that at least two of said idlers exert a force against an individual one of said articles as said articles move along said main conveyor.

9. A transport for conveying a plurality of articles between the output side of a manufacturing device and a second position, comprising:

a plurality of longitudinally aligned take-away means, each of said take-away means including a conveying device for transporting individual ones of said articles in a first direction, each of said conveying devices having substantially equal lengths, said aligned take-away means plutality receiving a group of articles from said manufacturing device in substantial alignment, and a plurality of first idlers for maintaining positive control on the articles, said articles being carried between said conveying device and said idler plurality as said articles pass through said take-away means, the conveying device of each of said take-away means plurality having substantially equal lengths and being driven at progressively different speeds so as to stagger alignment of said articles;

a main conveyor having an upper side and a lower side;

guide means positioned at the termination of said take-away means plurality and aligned with the direction of travel of said main conveyor, said guide means including an edge alignment guide for receiving an edge of individual ones of said articles;

at least one main guide idler positioned at the termination of each of said take-away means plurality, said main guide idler abutting said main conveyor on said lower main conveyor side, said articles being inserted between said main guide idlers and the lower side of said conveyor, said main guide idlers exerting a force on said articles which tends to move said articles toward abuttment with the edge alignment guide of said guide means;

means for driving said main conveyor; and means for varying the speed of said conveying devices, said speed varying means being set so that the difference in speeds of said take-away means will vary the spacing between the groups of articles but maintain a constant spacing between articles of each group, the minimum spacing between groups being approximately equal to the space between individual articles in any particular group.

* * * * *